US006706983B2

(12) United States Patent
Tsao et al.

(10) Patent No.: US 6,706,983 B2
(45) Date of Patent: Mar. 16, 2004

(54) MULTI-FUNCTION ERRONEOUS CONTACT PROTECTION STRUCTURE FOR ELECTRONIC DEVICE KEYBOARDS

(75) Inventors: Johnson Tsao, Taipei Hsieng (TW); Hsin-Yuan Yang, Taipei Hsieng (TW)

(73) Assignee: Inventec Appliances Corp., Taipei Hsieng (TW)

( * ) Notice: Subject to any disclaimer, the term of this patent is extended or adjusted under 35 U.S.C. 154(b) by 0 days.

(21) Appl. No.: 10/180,532

(22) Filed: Jun. 27, 2002

(65) Prior Publication Data

US 2004/0000468 A1 Jan. 1, 2004

(51) Int. Cl.[7] ..... H01H 9/00
(52) U.S. Cl. ..... 200/310; 200/5 A
(58) Field of Search ..... 200/5 A, 517, 200/310, 312, 317; 341/20–23

(56) References Cited

U.S. PATENT DOCUMENTS 4,501,937 A * 2/1985 Anderson et al. ..... 200/5 A
4,531,034 A * 7/1985 Inaba ..... 200/314
5,801,345 A * 9/1998 Mikula-Curtis et al. .... 200/5 A
6,552,289 B2 * 4/2003 Kawaguchi et al. ..... 200/512

* cited by examiner

*Primary Examiner*—Michael A. Friedhofer
(74) *Attorney, Agent, or Firm*—Bacon & Thomas

(57) ABSTRACT

The invention is to provide a multi-function erroneous contact protection structure for electronic device keyboards in which a minimum of one transparent cover is positioned at the lateral edge of at least one key switch on the case of an electronic device with one end of the said cover protruding from the said case at a height equal to or greater than that of the said key switches, the protruding cover structure of the case enabling the simultaneous touching of the said cover when the user strikes a said key switch, reminding the user that the said key switch is a critical key switch and thereby preventing erroneous contact with the said key switch.

3 Claims, 2 Drawing Sheets

MULTI-FUNCTION ERRONEOUS CONTACT PROTECTION STRUCTURE FOR ELECTRONIC DEVICE KEYBOARDS

BACKGROUND OF THE INVENTION

1) Field of the Invention

The invention herein relates to a multi-function erroneous contact protection structure for electronic device keyboards.

2) Description of the Prior Art

Current consumer demand for miniaturized, multi-functional, and easy-to-use electronic devices has given rise to the palm-top electronic devices that are characteristically lightweight, ultra-thin, and versatile. Attracting the most attention among these numerous high technology electronic products and palm-top electronic devices are personal digital assistants (PDA) having network connection capability.

To achieve compactness that facilitates the objective of portability, a conventional PDA typically has a keyboard of reduced surface area. However, in such reduced surface area keyboards, since the key switches of the said keyboards are of diminished size and, furthermore, the distance between each key switch is decreased, when the user strikes the said keys, it is easy to mistakenly touch a critical key (such as the power or delete key), the consequence of which is serious loss of data.

SUMMARY OF THE INVENTION

The objective of the invention herein is to provide a multi-function erroneous contact protection structure for electronic device keyboards in which a minimum of one transparent cover is positioned at the lateral edge of at least one key switch on the case of an electronic device with one end of the said cover protruding from the said case at a height equal to or greater than that of the said key switches, the protruding cover structure of the case enabling the simultaneous touching of the said cover when the user strikes a said key switch, reminding the user that the said key switch is a critical key switch and thereby preventing erroneous contact with the said key switch.

Another objective of the invention herein is to provide a multi-function erroneous contact protection structure for electronic device keyboards in which a light-emitting diode is situated inside the said cover; the terminals of the said light-emitting diode are connected to the control circuit of the said electronic device such that the said light-emitting diode is triggered by the operation of the control circuit, with its beam projected through the said cover to indicate the operating status of the said electronic device.

The above and other objects, features and advantages of the present invention will become apparent from the following detailed description taken with the accompanying drawings.

DETAILED DESCRIPTION OF THE INVENTION

Figure 1:
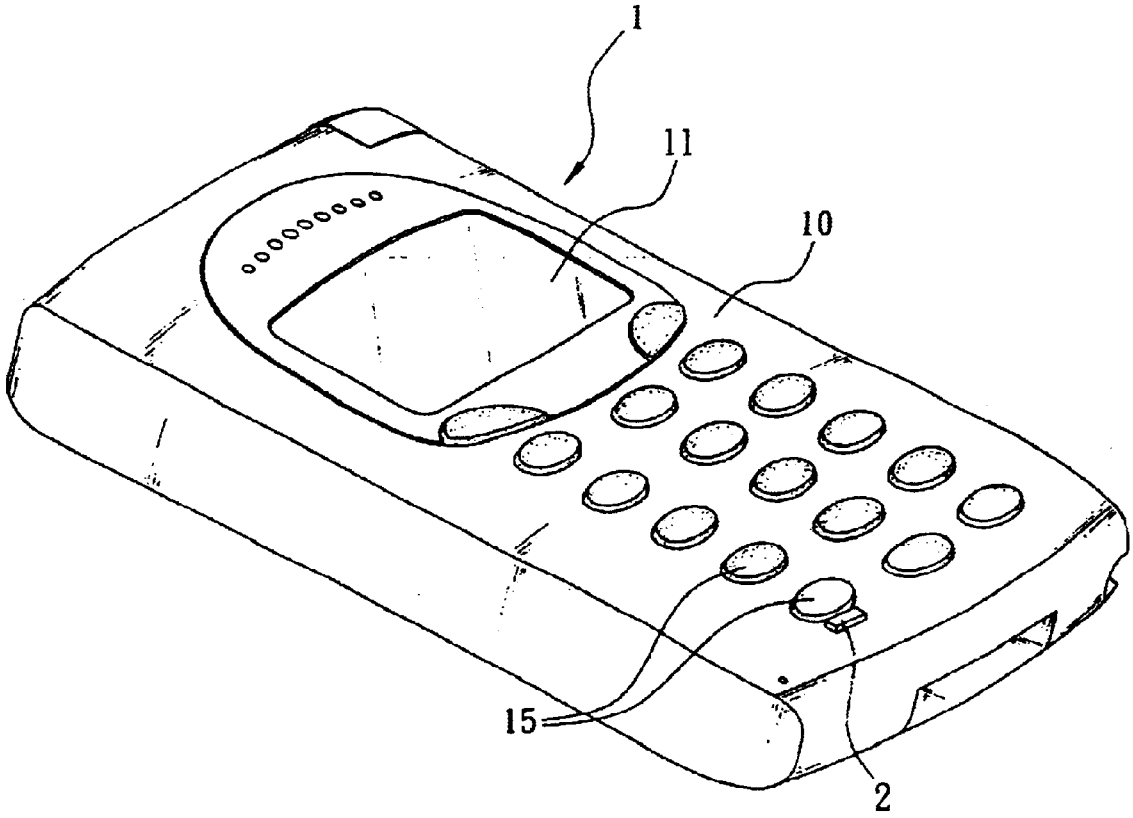
FIG. 1 is an isometric drawing of a portable electronic device of the invention.
Figure 3:
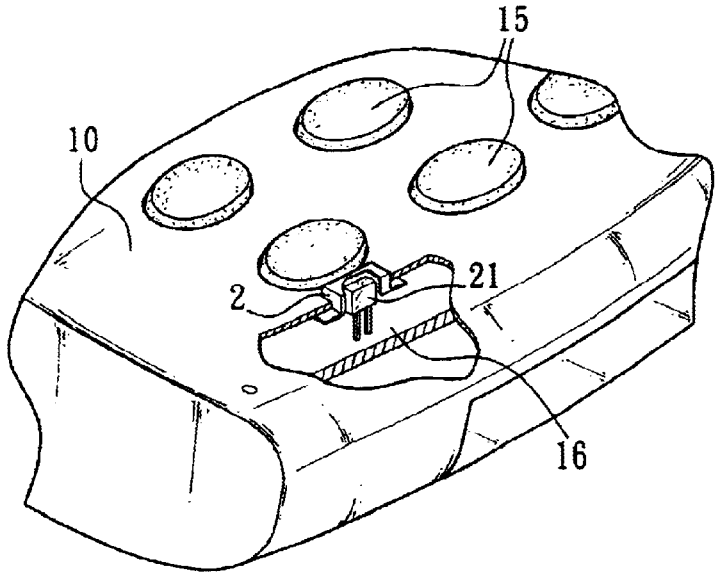
FIG. 3 is a partial, cross-sectional drawing of the invention herein.

The invention herein is a multi-function erroneous contact protection structure for electronic device keyboards; referring to FIG. 1, the said electronic device 1 can be a portable personal digital assistance (PDA), the said electronic device 1 is contained in a case 10, the said case 10 having a display opening in one end and plurality of key switch holes arrayed in even rows at the opposite end, wherein an installation hole is disposed at the lateral edge of at least one key switch hole; a control circuit 16 (as shown in FIG. 3) is installed inside the said case 10, the said control circuit 16 utilized to govern the operations of the electronic device 1; a display screen 11 is mounted in the said display opening, the said display screen 11 has wiring and the said wiring and the said control circuit 16 are connected together to couple the said display screen 11 to the control circuit 16 such that data processed by the said control circuit 16 is viewable on the said display screen 11; and a key switch 15 is positioned in each of the said key switch holes, with one end of the said key switches 15 projecting from the surface of the said case 10, enabling the locating of the said key switches 15 and the generation of different alphanumeric characters and commands to the said control circuit 16 following their depression.

Figure 2:
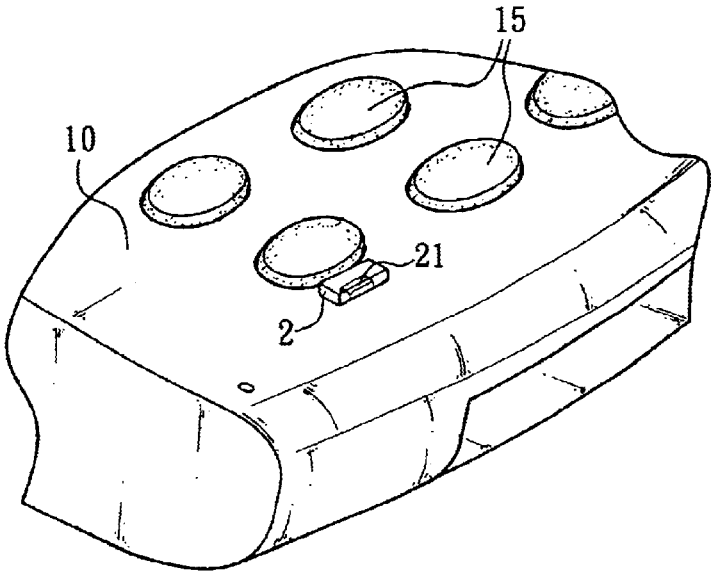
FIG. 2 is an magnified, partial isometric drawing of the invention herein.

Referring to FIG. 1 and FIG. 2, a transparent cover 2 (in the embodiment herein, the said transparent cover 2 is a long strip, but is not limited to such a form during the actual utilization of the present invention) is positioned in the said installation hole with one end of the said cover 2 protruding from the said case 10 at a height equal to or greater than that of the said key switches 15, the protruding cover 2 structure of the case 10 enabling the simultaneous touching of the said cover 2 when the user strokes a said key switch 15, reminding the user that the said key switch 15 is an important key switch (such as a delete key or power key) and thereby preventing erroneous contact with the said key switch 15.

Referring to FIG. 2 and FIG. 3, a recess is formed in the bottom surface of the said cover 2; a light-emitting diode 21 is situated inside the said recess and the terminals of the said light-emitting diode 21 are connected to the said electronic device 1 control circuit 16 such that the said light-emitting diode 21 is triggered by the operation of the electronic device 1 control circuit 16, with its beam projected through the said cover 2 to indicate the operating status of the said electronic device 1.

In the invention herein, the said light-emitting diode 21 can be components of differing color specifications (such as red, green, or yellow, etc.).

In the invention herein, the said electronic device 1 is equipped with a rechargeable battery and, furthermore, has a recharging circuit in its control circuit 16; the said recharging circuit is connected to the said rechargeable battery such that when the said electronic device 1 is in the process of recharging, the said control circuit 16 activates the said light-emitting diode 21 which flashes red to indicate that the said electronic device 1 is in the process of recharging the battery; and when the said rechargeable battery is fully recharged, the said control circuit 16 causes the said light-emitting diode 21 to continuously glow red to inform the user that the said electronic device 1 has completed recharging.

In the invention herein, when the user connects the said electronic device 1 to a network and data is being transferred, its control circuit 16 causes the said light-emitting diode 21 to glow yellow as an indication to the user.

In the invention herein, when the user switches on the said electronic device 1 into the operational state, its control circuit 16 causes the said light-emitting diode 21 to glow green as an indication to the user.

In the invention herein, the said cover 2 has an outwardly extending exterior periphery along its bottom section and the said cover 2 is fitted upward into the said case 10 installation hole from the lower extent of the said case 10 such that the said cover 2 is retained at the bottom surface of the said case 10 because of its exterior periphery and cannot be dislodged from the said case 10.

Given the assembly of the said structural components, the protruding cover 2 structure of the case 10 is such that when the user strokes the said key switch 15, the said cover 2 is simultaneously touched, reminding the user that the said key switch 15 is a critical one and thus averts erroneous contact with the said key switch 15, while the said light-emitting diode 21 within the said cover 2 provides a luminous signal of the various operations of the said control circuit 16 which is beamed through the transparent said cover 2 to indicate the operating status of the said electronic device 1.

While the invention has been described by means of specific embodiments, numerous modifications and variations could be made thereto by those skilled in the art without departing from the scope and spirit of the invention set forth in the claims.

What is claimed is:

1. A multi-function erroneous contact protection structure for electronic device keyboards comprised of:

at least one case having a display opening and plurality of key switch holes arrayed in even rows in a face of said case said face having an upper and bottom surface, wherein an installation hole is disposed at an edge of at least one of said key switch holes;

a control circuit Installed inside said case that is utilized to govern operations of an electronic device;

a display screen mounted in said display opening, the wiring of which is connected to the control circuit;

a plurality of key switches respectively positioned in said key switch holes and projecting from the surface of said case, enabling location of said key switches and generation of different alphanumeric characters and commands to said control circuit following depression;

a transparent cover positioned in said Installation hole which protrudes from the surface of said case at a height equal to or greater than that of said key switches and, furthermore, a recess is formed in the bottom surface of said cover;

a light-emitting diode is situated inside said recess at said cover bottom surface, with the terminals of said light-emitting diode connected to said electronic device control circuit such that said light-emitting diode is triggered by the operation of said control circuit and a beam projected through said cover.

2. A multi-function erroneous contact protection structure for electronic device keyboards as claimed in claim 1 in which said light-emitting diode can be a red, green, or yellow light-emitting diode.

3. A multi-function erroneous contact protection structure for electronic device keyboards as claimed in claim 1 in which said cover has an outwardly extending exterior periphery along its bottom section and said cover is fitted upward into said case installation hold from the lower extent of said case such that said cover is retained in the bottom surface of said case because of its exterior periphery and cannot be dislodged from said case.

* * * * *